US006256916B1

(12) United States Patent
McNulty

(10) Patent No.: US 6,256,916 B1
(45) Date of Patent: Jul. 10, 2001

(54) STUN GUN

(75) Inventor: Thomas Vi McNulty, Calimesa, CA (US)

(73) Assignee: Electronic Medical Research Laboratories Inc., Newport Beach, CA (US)

( * ) Notice: Subject to any disclaimer, the term of this patent is extended or adjusted under 35 U.S.C. 154(b) by 0 days.

(21) Appl. No.: 09/236,694

(22) Filed: Jan. 25, 1999

(51) Int. Cl.[7] ..... F41C 9/00
(52) U.S. Cl. ..... 42/1.08; 361/232; 89/1.11
(58) Field of Search ..... 42/106, 1.08, 84, 42/1.11, 1.09; 361/232; 463/47.3

(56) References Cited

U.S. PATENT DOCUMENTS 2,208,852 * 7/1940 Mongan ..... 231/2
4,688,140 * 8/1987 Hammes ..... 361/232
5,282,332 * 2/1994 Philips ..... 42/1.08
5,467,247 * 11/1995 de Anda ..... 361/232
5,654,867 * 8/1997 Murray ..... 361/232
5,973,477 * 10/1999 Chang ..... 320/114

* cited by examiner

*Primary Examiner*—Charles T. Jordan
*Assistant Examiner*—J Lofdahl
(74) *Attorney, Agent, or Firm*—Leonard Tachner

(57) ABSTRACT

A stun gun having an electrically insulated protuberance that extends to a height above the line between the vertical terminations of the exposed electrical target contacts. Before the weapon's target probes can be brought in contact with the target, the insulative protuberance compresses the target's muscle. This action shortens the length of the muscle while increasing the area of tissue involved in a subsequent shocking discharge. This, in turn, increases the likelihood of a sustained involuntary flexing or extending contraction of the muscle. A rectangular ammunition bay may be placed in the weapon with a portion of one partially exposed probe touching the ammunition's negative contact and a portion of the other partially exposed probe touching the ammunition's positive contact. In the event of a ballistic deployment failure, without the addition of any circuitry, the weapon can still act as a manual contact weapon.

6 Claims, 2 Drawing Sheets

STUN GUN

BACKGROUND OF THE INVENTION

1. Field of the Invention

This invention relates to a class of weapons for immobilization and capture which are referred to as "stun guns" and more specifically to a subclass of those weapons having a pair of electrically opposed target probes between which a current is generated to disable a human or other animal target when the probes are manually placed in contact with such target and the weapon is energized.

2. Prior Art

Manually connected electrical discharge weapons are intended to be hand held, concealable upon the person, and conveniently portable. Accordingly, such a weapon's height is normally less than 7", its width is normally less than 2.75", and its depth is about 0.75". The target contacts are typically spaced about 2.5" apart along the weapon's width. The weapons shock with circuits similar to those described in U.S. Pat. No. 4,253,132, titled Power Supply For Weapon For Immobilization And Capture and issued to John Cover in February, 1981, for inclusion in stun guns with ballistic delivery systems.

Numerous U.S. Patents have been granted for improvement of these manually connected weapons. U.S. Pat. No. 4,688,140 issued to Hammes in August, 1987; U.S. Pat. No. 4,872,084 issued to Dunning, et al, in October, 1989; U.S. Pat. No. 5,193,048 issued to Kaufman, et al, in March, 1993, and U.S. Pat. No. 5,654,867 issued to Murray in August, 1997.

According to a report at page 41 of Volume 33, Number 6, that is the June, 1985 copy of the journal *Law and Order*, during a portion of a field test of the manually connected weapons conducted by the Dallas, Tex. Police Department, the weapons were found to be ineffective at helping to control suspects an astounding 63% of the time. In fact, some officers participating in the study stated that use of the weapons did little more than further incite already violent suspects. Experiments reported in U.S. Pat. No. 5,841,622 establish that the typical probe spacing on the manually connected shock weapons is inadequate for immobilizing a human target. At least several additional inches of space is needed between the contacts or the weapon shock may be insufficient to cause a sustained involuntary contraction of the target's muscle, which contraction is sufficient to rigidly fixate joints and hamper ambulation. Targets may (but cannot be predicted to) submit during stun gun applications as the result of pain compliance. Moreover, experimental observations also disclosed in U.S. Pat. No. 5,841,622 establish that at safe power levels of 5 watts or less, even with adequate spacing between the contacts, the shocks are insufficient to cause muscular contractions that will move limbs. During or prior to the shock, the target must first contract muscle to flex or extend the limb where the additional electrically stimulated contraction is sufficient to fixate the limb, preventing antagonist muscles from returning the limb to its previous position. A target may pull away from the shock before this happens.

SUMMARY OF THE INVENTION

The present invention comprises a stun gun having an electrically insulated protuberance that extends to a height above the line between the vertical terminations of the exposed target contacts. This invention resolves both problems described above. Before the weapon's target probes can be brought in contact with the target, the insulative protuberance compresses the target's muscle. This action shortens the length of the muscle while increasing the area of tissue involved in a subsequent shocking discharge. This, in turn, increases the likelihood of a sustained involuntary flexing or extending contraction of the muscle. The weapon height need not be significantly increased. In fact, in one preferred embodiment where the probes are positioned diagonally from each other across the weapon's square head, the weapon size need not be increased at all. Moreover, a rectangular ammunition bay may be placed in the weapon with a portion of one partially exposed probe touching the ammunition's negative contact and a portion of the other partially exposed probe touching the ammunition's positive contact. In the event of a ballistic deployment failure, without the addition of any circuitry, the weapon can still act as a manual contact weapon. Stun guns with ballistic delivery systems do not have this capacity as the ammunition detonating and target disabling circuitry is usually inaccessible absent the addition of circuitry.

OBJECTS OF THE INVENTION

It is therefore a principal object of the present invention to provide an improved hand-held electrical stun gun having a wider discharge gap for increasing effectiveness.

It is another object of the invention to provide a stun gun configuration wherein the electrical target contacts therefor are located on opposing sides of a mechanical protrusion.

It is still another object of the present invention to provide a stun gun configuration wherein the shape of the end of the gun which contacts a target, promotes more effective muscle reaction to the ensuing electrical discharge.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
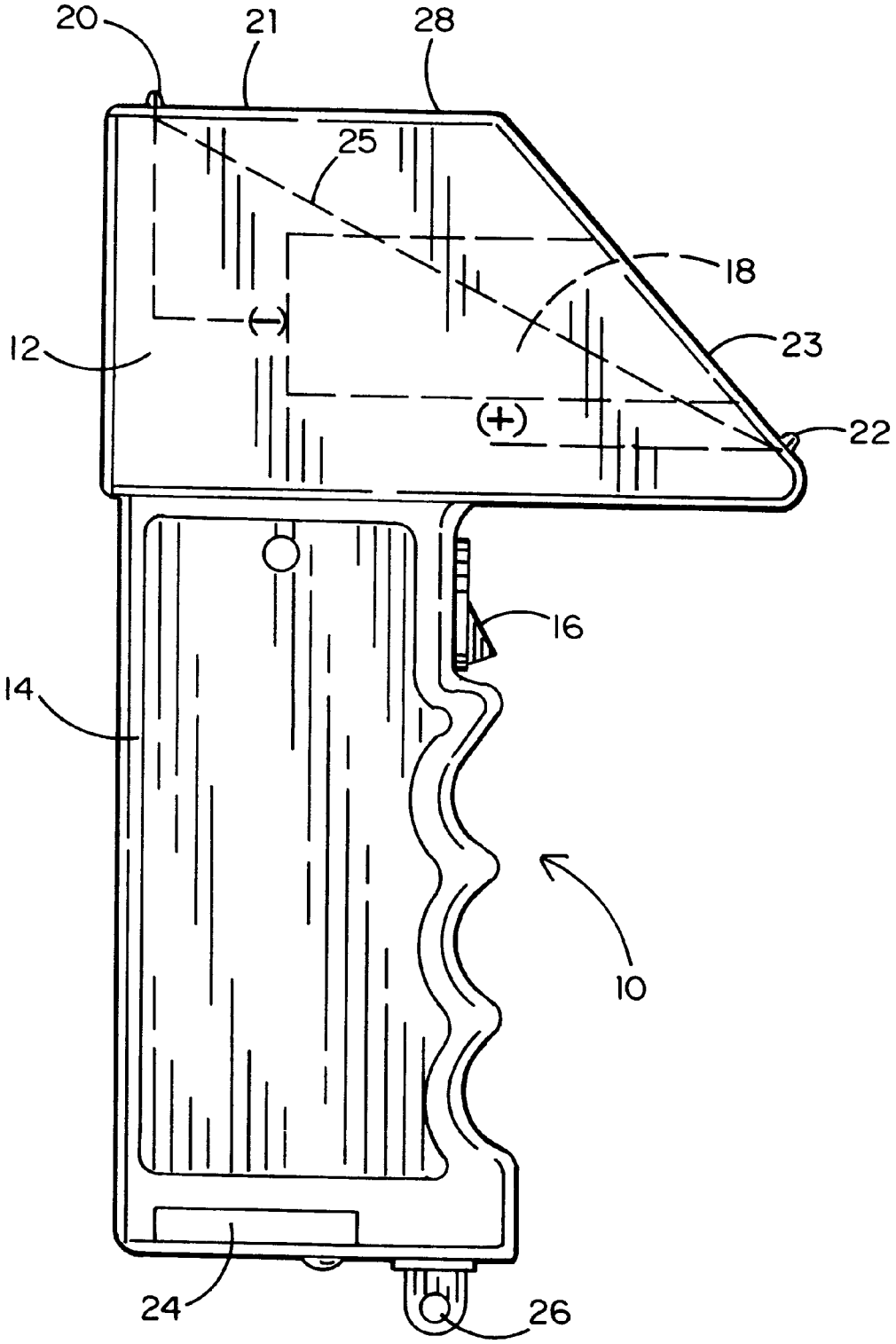
FIG. 1 is a side view of a preferred embodiment of the invention.

Referring to the accompanying figures, it will be seen that a stun gun 10 in accordance with the present invention comprises a head portion 12 and an integral handle portion 14. The stun gun electronics (not shown) are conventional and are contained within handle portion 14 where they may be selectively activated by a trigger switch 16.

This embodiment of the invention provides a launchable projectile in the form of wire-tethered darts in a conventional cartridge that is received in a cartridge receptacle 18 in head portion 12. More pertinent to the inventive aspect of the disclosed stun gun apparatus, is a pair of electrical contacts 20 and 22 projecting above respective surfaces 21 and 23 of the head portion 12. The handle portion is also provided with a battery compartment cover 24 and a wrist-band holder 26.

The shape of head portion 12 as seen in FIG. 1 is trapezoidal. This trapezoidal shape is characterized by a foreshortened top surface 21 (as compared to the bottom of head portion 12) and a diagonal surface 23. Electrical contacts 20 and 22 are positioned near opposing respective corners of the trapezoidal shape so that a line connecting the contacts would appear as dotted line 25 which intersects the trapezoid. The significance of dotted line 25 is that a significant portion of head portion 12 lies above line 25.

Figure 2:
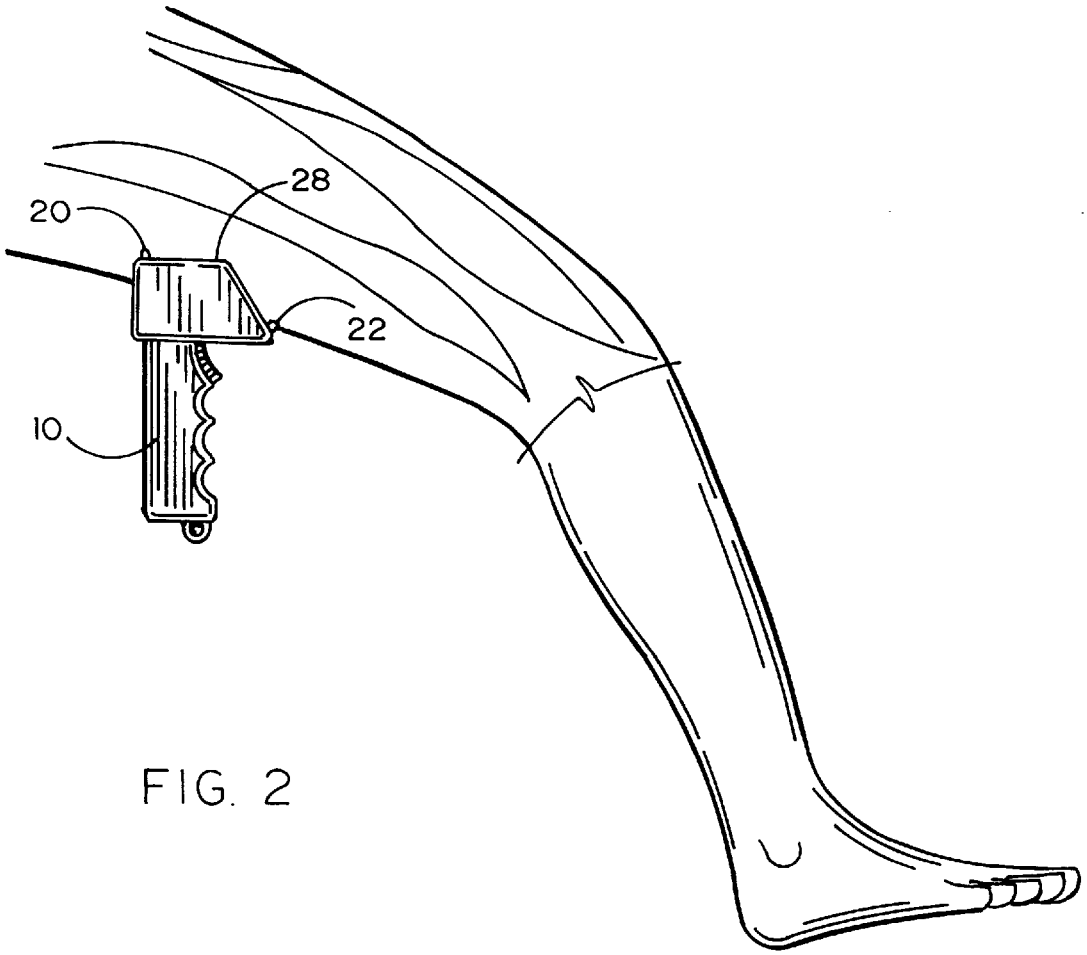
FIG. 2 is a view of the invention shown in contact with the leg muscles of a human target.
Figure 3:
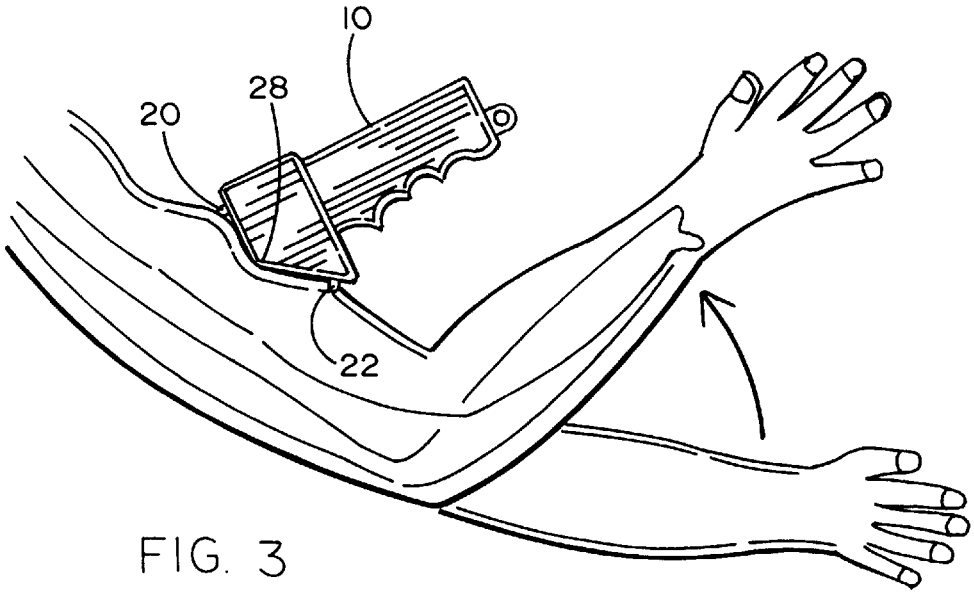
FIG. 3 is a view of the invention shown in contact with the arm muscles of a human target.

Consequently, in order to force both electrical contacts 20 and 22 to be simultaneously touching a target, the protruding portion 28 of head portion 12 must be pressed into the target in a manner shown in FIGS. 2 and 3. Moreover, this arrangement provides a greater distance between the contacts 20 and 22 that would be the case if, for example, surfaces 21 and 23 were combined into one flat top surface.

As shown in FIGS. 2 and 3, contacts 20 and 22 can only simultaneously contact the leg or arm of a target with protrusion 28 pushed into the limb which tends to depress and contract the muscle and spread the electrical discharge over a wider region. The result is a much more likely effective disability of the target than with conventional stun guns.

Having thus disclosed a preferred, but nevertheless illustrative embodiment of the invention, it being understood that the scope of the protection hereof may not necessarily limited such disclosure, what is claimed is:

1. A stun gun having a head portion and a handle portion, and having electronics for generating a high voltage applied to a pair of spaced-apart target contacts positioned at externally exposed locations in the head portion, the head portion comprising a non-conductive protuberance extending beyond a plane intersecting said contacts for increasing the effective discharge gap distance between said probes;

wherein said head portion comprises a trapezoidally-shaped cross-section having four corners and wherein said contacts are located adjacent respective non-adjacent ones of said four corners.

2. The stun gun recited in claim 1 wherein said head portion further comprises a receptacle for receiving a projectile cartridge having wire-tethered darts for disabling a remote target.

3. The stun gun recited in claim 1 wherein said handle portion comprises a trigger switch for selectively applying said high voltage to said contacts.

4. A stun gun for disabling a live target by discharging a pulsed, high voltage, low current into the target; the stun gun comprising:

a head portion and a handle portion integral to said head portion, said portions having electronics for generating said pulsed, high voltage, said head portion having at least two spaced apart target contacts positioned at externally exposed locations;

said at least two contacts lying in a common plane which intersects said head portion, the part of said head portion intersecting said plane forming a non-conductive protuberance for increasing the effective discharge gap distance between said contacts;

wherein said head portion comprises a trapezoidally-shaped cross-section having four corners and wherein said contacts are located adjacent respective non-adjacent ones of said four corners.

5. The stun gun recited in claim 4 wherein said head portion further comprises a receptacle for receiving a projectile cartridge having wire-tethered darts for disabling a remote target.

6. The stun gun recited in claim 4 wherein said handle portion comprises a trigger switch for selectively applying said high voltage to said contacts.

* * * * *